US006612235B2

(12) United States Patent
Frankenberger et al.

(10) Patent No.: US 6,612,235 B2
(45) Date of Patent: Sep. 2, 2003

(54) SHEET GUIDING DEVICE

(75) Inventors: Eckart Frankenberger, Darmstadt (DE); Michael Gieser, Oftersheim (DE); Christian Görbing, Heidelberg (DE); Peter Hachmann, Dossenheim (DE); Karl-Heinz Helmstädter, Heidelberg (DE); Christian Hieb, Neuhofen (DE); Ruben Schmitt, Heidelberg (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/944,575

(22) Filed: Aug. 31, 2001

(65) Prior Publication Data

US 2002/0078842 A1 Jun. 27, 2002

(30) Foreign Application Priority Data

Aug. 31, 2000 (DE) ..... 100 42 888

(51) Int. Cl.[7] ..... B41F 13/02; B65H 29/24
(52) U.S. Cl. ..... 101/231; 101/232; 271/196
(58) Field of Search ..... 101/231, 232; 271/794, 795, 796, 797; 138/37, 40, 42, 44

(56) References Cited

U.S. PATENT DOCUMENTS

| | | | | |
|---|---|---|---|---|
| 3,429,544 A | | 2/1969 | Williams, III | |
| 3,823,743 A | * | 7/1974 | King | 138/42 |
| 4,043,360 A | * | 8/1977 | Yaron | 138/42 |
| 4,411,292 A | * | 10/1983 | Schiller | 138/42 |
| 4,572,071 A | * | 2/1986 | Cappel et al. | 101/183 |
| 5,327,941 A | * | 7/1994 | Bitsakis et al. | 138/42 |
| 5,988,633 A | | 11/1999 | Henn et al. | |
| 6,170,819 B1 | * | 1/2001 | Crosby et al. | 271/196 |

FOREIGN PATENT DOCUMENTS

| | | |
|---|---|---|
| DE | 42 44 002 A1 | 7/1994 |
| DE | 196 28 620 A1 | 1/1998 |
| DE | 198 29 094 A1 | 1/2000 |
| DE | 198 57 745 A1 | 6/2000 |
| DE | 199 05 095 A1 | 8/2000 |

* cited by examiner

*Primary Examiner*—Stephen R. Funk
*Assistant Examiner*—Leo T. Hinze
(74) *Attorney, Agent, or Firm*—Lawrence A. Greenberg; Werner H. Stemer; Ralph E. Locher

(57) ABSTRACT

A guiding device in a machine for processing sheets of printing material includes unthrottled air nozzles for contact-free guidance of the sheets, and throttled air nozzles arranged at locations which are prone to contact by the sheets; and a machine for processing sheets of printing material and a sheet-fed rotary printing machine, respectively, having the guiding device.

14 Claims, 6 Drawing Sheets

SHEET GUIDING DEVICE

BACKGROUND OF THE INVENTION

Field of the Invention

The invention relates to a sheet guiding device in a machine for processing sheets of printing material, which have unthrottled air nozzles for guiding the sheets in a contact-free manner.

The published German Patent Document DE 19628 620 A1 describes such a guiding device which serves for guiding freshly printed sheets and which includes a first nozzle configuration having blast air nozzles for generating air jet beams and a second nozzle configuration having blast air nozzles for generating torsional flows. In an exemplifying embodiment, a nozzle body with helical channels, which is constructed as a cylindrical cup or bowl with a worm fitted therein, is connected to a blast air nozzle of the second nozzle configuration body, at a location upline therefrom. The channels, which are helically rather than spirally formed, cause virtually no throttling of the blast air.

A disadvantage of the aforedescribed guiding device is that the torsional flow is not optimally effective under all operating conditions, and the flow intensity must be readjusted whenever there are changes in the conditions, such as a change in the printing material, for example. If this readjustment should occur imprecisely or too late, there is a danger of smearing the freshly printed sheet at locations of the guiding device which are susceptible or prone to contact.

The state of the prior art additionally includes a guide mechanism as described in the published German Patent Document DE 198 29 094 A1, which has porous guide surfaces by which diffuse airflows can be generated. This guide mechanism is operable module by module in a suction mode, so that suction and a frictional, i.e., gliding, transport of the sheet along a respective guide surface can occur in problem areas of the sheet guiding system. This technical solution thus purposely deviates from the principle of contact-free sheet guidance.

The side of the sheet which is acted upon by the suction can slide on the guide surface, without smearing, only if this side is unprinted.

SUMMARY OF THE INVENTION

It is accordingly an object of the invention to provide a sheet guiding device of the general type described in the introduction hereto, which ensures contact-free sheet transport even under changing operating conditions, and which is particularly well suited for guiding sheets which have been freshly printed on both sides thereof.

With the foregoing and other objects in view, there is provided, in accordance with one aspect of the invention, a guiding device in a machine for processing sheets of printing material, comprising unthrottled air nozzles for contact-freely guiding the sheets, and throttled air nozzles arranged at locations which are prone to contact by the sheets.

In accordance with another feature of the invention, the throttled air nozzles are located at a contact-prone curve of a guide surface.

In accordance with a further feature of the invention, the throttled air nozzles are located at a contact-prone end region of a guide surface.

In accordance with an added feature of the invention, the unthrottled air nozzles are pneumatically connected by way of a first air conducting system, and the throttled air nozzles are pneumatically connected by way of a second air conducting system, for providing a prevailing air pressure $p_1$ in the first air conducting system which is less than an air pressure $P_2$ prevailing in the second air conducting system.

In accordance with an additional feature of the invention, at least one of the throttled air nozzles is assigned to an air throttle.

In accordance with yet another feature of the invention, the air throttle includes a fill.

In accordance with yet a further feature of the invention, the air throttle includes a filter-type throttle piece.

In accordance with yet an added feature of the invention, the air throttle is formed with a spiral air channel.

In accordance with yet an additional feature of the invention, the air throttle includes protruding air barriers and eddy chambers located therebetween.

In accordance with still another feature of the invention, the air throttle includes perforated plates disposed on top of one another, with eddy chambers located therebetween.

In accordance with still a further feature of the invention, the throttled air nozzles are blast air nozzles.

In accordance with still an added feature of the invention, the unthrottled air nozzles are blast air nozzles.

In accordance with another aspect of the invention, there is provided a machine for processing sheets of printing material having at least one sheet guiding device, comprising unthrottled air nozzles for contact-free guidance of the sheets, and throttled air nozzles arranged at locations which are prone to contact by the sheets.

In accordance with a further feature of the invention, the guiding device is integrated into a sheet delivery.

In accordance with a concomitant aspect of the invention, there is provided a sheet-fed rotary printing machine having at least one sheet guiding device, comprising unthrottled air nozzles for contact-free guidance of sheets, and throttled air nozzles arranged at locations which are prone to contact by the sheets.

A blast or blowing force which is exerted by each of the throttled air nozzles upon the sheets increases overproportionately, i.e., more than linearly, as the distance of the sheet from the respective air nozzle decreases. Thus, it is possible to generate an air cushion between the sheet and a guide surface of the guiding device, the guide surface being provided with the throttled air nozzles, which holds the sheet at a spaced distance from the guide surface much more reliably than is possible with unthrottled air nozzles.

An additional advantage is in the small volume flow generated by the throttled air nozzles, because the infiltrated or leaked air flow generated by the throttled air nozzles which are not covered by the sheet (dependent upon the format) is consequently rather small and does not have to be blocked.

In developments which are advantageous with respect to the realization of the sheet guiding device, including a guide surface in a sheet delivery, the contact-prone locations are provided at a curve or an end region of the guide surface. The guided sheet is prevented completely for all practical purposes from engaging or stopping at the guide surface, even in the region of the contact-prone locations of the guide surface, by the influence of the throttled air nozzles upon the sheet.

In a development which is advantageous with respect to the realization of the unthrottled air nozzles as conventional impulse-blast nozzles, e.g., venturi nozzles or torsion jet nozzles, the unthrottled air nozzles are chargeable with excess pressure by way of a first air conducting system, and the throttled air nozzles are chargeable with excess pressure by way of a second air conducting system, the excess pressure of the unthrottled air nozzles being less than the excess pressure of the throttled air nozzles.

In a separate development, each of the throttled air nozzles is connected to an air pressure generator by way of an air throttle. The air throttle can be integrated into the second air conducting system distal from the respective throttled air nozzle. This is expedient when providing an air throttle which is pneumatically connected to several throttled air nozzles simultaneously by way of the second air conducting system. The air throttle and the air nozzle throttled thereby can also be constructed as a single unit in the form of a throttle nozzle. In this case, a separate air throttle is assigned to each of the throttled air nozzles.

In a further development, a so-called fill column forms an internal component of the air throttle, the fill elements thereof forming flow resistors for the blast air which is generated by the air pressure generator and which flows through the air throttle.

In a separate development, an airfilter-type throttle piece is an internal component of the air throttle and forms a flow resistor for the blast air. For example, the throttle piece may be a textile layer which may or may not be woven. The throttle piece may also be a porous and, therefore, air-permeable sponge foamed from a plastic material.

In a separate embodiment, the air throttle contains air barriers which protrude into the flow path of the blast air and which define eddy chambers.

In a separate development, the air throttle is constructed as a so-called perforated plate maze or labyrinth.

Other features which are considered as characteristic for the invention are set forth in the appended claims.

Although the invention is illustrated and described herein as embodied in a sheet guiding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
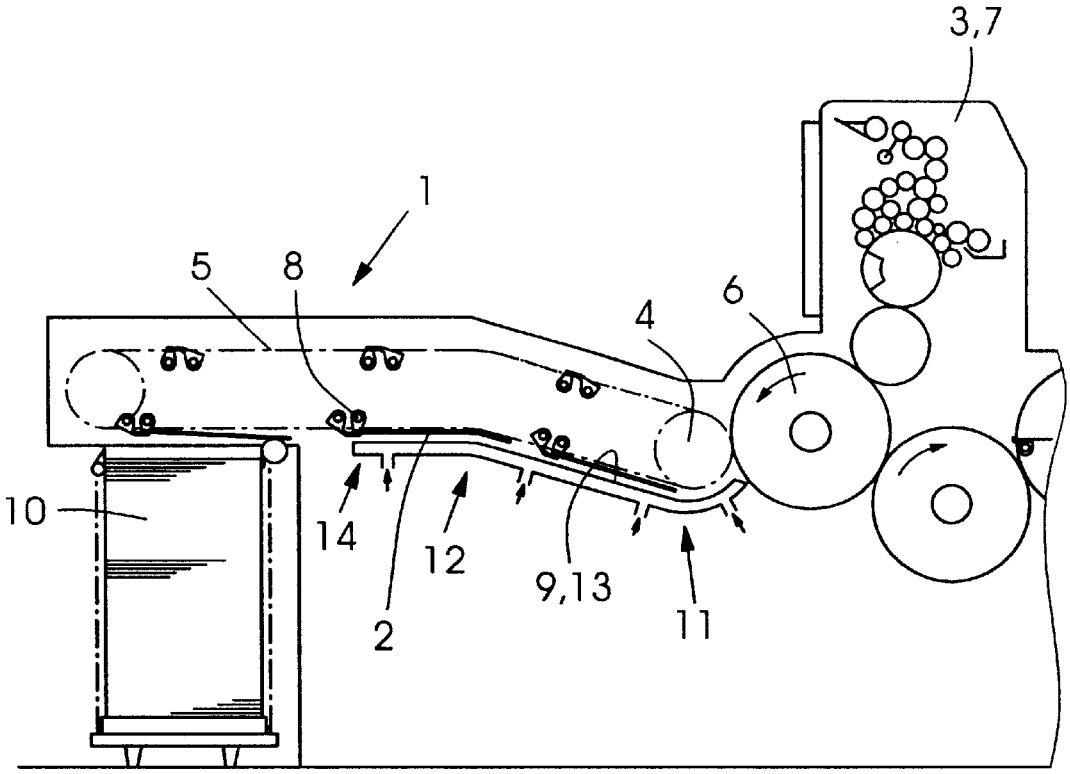
FIG. 1 is a fragmentary diagrammatic side elevational view of a sheet processing machine, showing the sheet delivery thereof which includes a guide surface.

Referring now to the drawings and, first, particularly to FIG. 1 thereof, there is represented therein a sheet delivery 1 of a machine for processing sheets 2, more particularly, a sheet-fed rotary printing press 3, which prints both sides of the sheet 2 in one pass and which includes a sheet turning or reversing device. The sheet 2 is taken from an impression cylinder 6 of an offset printing unit 7 of the sheet-fed rotary printing press 3 by a chain conveyor 5 of the sheet delivery, which rotates about a delivery drum 4, is transported on a gripper bar 8 of the chain conveyor 5 along a guiding device 9 to a sheet pile or stack 10, and deposited thereat.

The guiding device 9 extends along a transport path of the sheet 2 under the chain conveyor 5 and includes, in the region of the delivery drum 4, a concave curve 11 of a guide surface 13 facing the chain conveyor 5 and conducting the sheet 2 pneumatically, as well as a convex curve 12 of the guide surface in the region of a transition from a rising section of the chain conveyor 5 to a section running horizontally. The curves 11 and 12 as well as an end region 14 of the guide surface 13 are locations which are particularly prone to contact, at which the sheet 2 tends to contact the guide surface 13. In order to prevent this contact and thus to ensure a contact-free influence of the guiding device 9 upon the sheet 2, specific constructional measures are taken at the contact-prone locations, which are described in detail hereinbelow.

Figure 2:
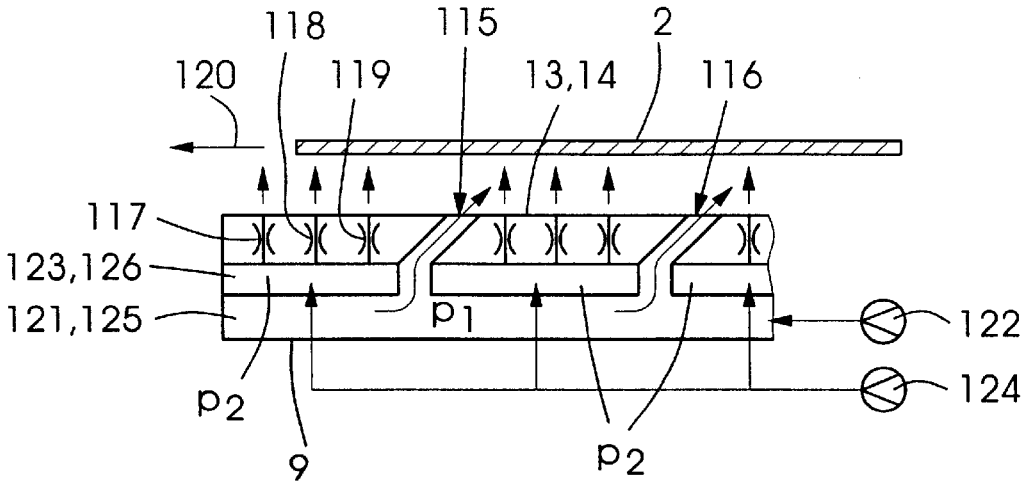
FIG. 2 is an enlarged fragmentary view of FIG. 1 showing, in section, the guide surface having throttled and unthrottled air nozzles therein.

FIG. 2, for example, represents these measures in the form of an arrangement, in the end region 14, of unthrottled air nozzles 115 and 116 and throttled air nozzles 117, 118 and 119, all of the air nozzles 115 to 118 being installed in the guide surface 13 and realized as air blast nozzles. The arrow 120 represents the transport direction of the sheet 2, relative to which the air jet direction of the unthrottled air nozzles 115 and 116 is oriented at an angle. The throttled air nozzles 117, 118 and 119 are oriented Perpendicularly to the transport direction 120. The throttled air nozzles 117, 118, and 119, which are represented only symbolically in FIG. 2, are arranged in groups next to the unthrottled air nozzles 115 and 116. The unthrottled air nozzles 115 and 116 are pneumatically connected to a first air pressure generator 122 by way of a first air conducting system 121, and the throttled air nozzles 117, 118 and 119 are pneumatically connected to a second air pressure generator 124 by way of a second air conducting system 123. Motor-driven air pressure generators 122 and 124 are constructed as excess pressure generators and, for example, as ventilators or blowers.

The first air conducting system 121 includes a first air chamber 125 from which the unthrottled air nozzles 115 and 116 diverge and which is connected to the first air pressure generator 122. The throttled air nozzles 117, 118 and 119 branch off from a second air chamber 126, which belongs to the second air conducting system 123. The second air pressure generator 124 generates an air pressure and an excess pressure, respectively, $p_2$ in the second air chamber 126, which is greater than an air pressure and an excess pressure, respectively, $p_1$ which is generated by the first air pressure generator 122 in the first air chamber 125 in that the second air pressure generator 124 runs at a higher rate of rotation than the first air pressure generator 122. The air flows through and from the air nozzles 115 and 119 are symbolized with arrows.

Figure 3:
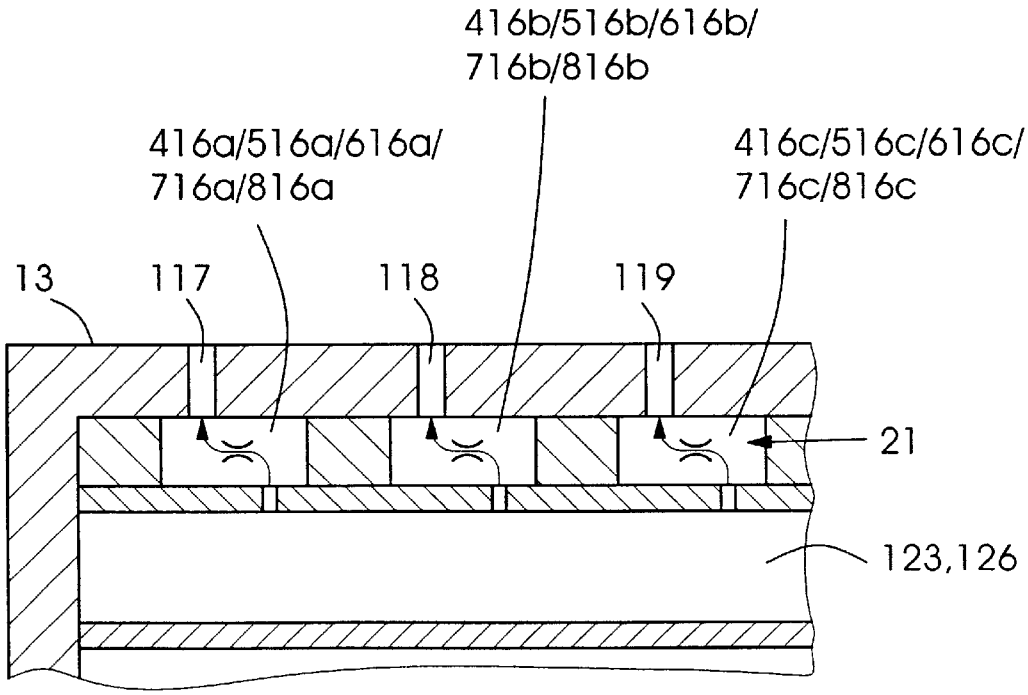
FIG. 3 is an enlarged fragmentary view of FIG. 2 showing, in section, a region of the guiding device having the throttled air nozzles and the air throttles assigned thereto.
Figure 4:
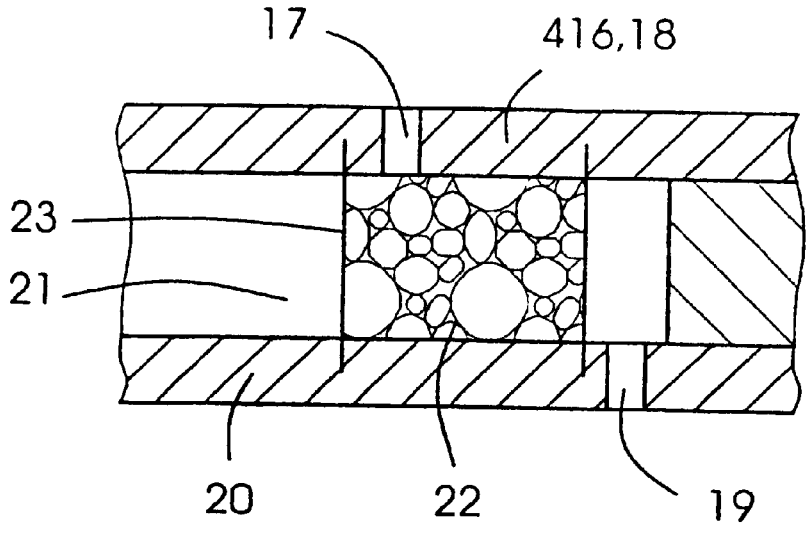
FIGS. 4, 5, 6*a*, 6*b*, 7*a*, 7*b* and 8 are sections of the guiding device showing various embodiments of the air throttles.

FIG. 3 shows a detailed section of a portion of the guiding device which includes the throttled air nozzles 117, 118 and 119, from which it is apparent that air throttles 416*a* to 416*c*, 516*a* to 516*c*, 616*a* to 616*c*, 716*a* to 816*c* or 816*a* to 816*c*, which are integrated into the second air conducting system 123, are assigned to the throttled air nozzles 117, 118 and 119 for throttling those nozzles.

It is also conceivable to dispose only a single, common or shared air throttle in the second air conducting system 123 downline from the throttled air nozzles 117, 118, and 119, via which each of the throttled air nozzles 117, 118 and 119 would be connected pneumatically to the second air pressure generator 122 and which would include an internal structure corresponding to that of FIGS. 4, 5, 6*a*, 6*b*, 7*a*, 7*b* or 8.

As represented in FIGS. 4, 5, 6*a*, 6*b*, 7*a*, 7*b* or 8, each of the air throttles 416*a* to 416*c*, 516*a* to 516*c*, 616*a* to 616*b*, 716*a* to 716*c* or 816*a* to 816*c* includes an outlet 17 in a ceiling 18 and an inlet 19 in a floor 20 of the respective throttle. The ceiling 18 and the floor 20 form the top and bottom boundaries of an intermediately arranged throttle chamber 21 through which the blast air generated by the second air pressure generator 124 flows.

Provided are several differently constructed embodiments of the air throttles 416*a* to 416*c*, 516*a* to 516*c*, 616*a* to 616*c*, 716*a* to 716*c* or 816*a* to 816*c*, which are represented in FIGS. 4, 5, 6*a*, 6*b*, 7*a*, 7*b* to 8 and are described hereinbelow with reference to those figures.

In the air throttle 416*a*, 416*b* and 416*c* (note FIG. 4), a fill 22 formed of fill bodies such as granulate, fibers, chips or spheres, for example, which are held together on both sides by a netting or lattice 23, is located in the airflow path in the chamber 21 between the inlet 19 and outlet 17 of the throttle. The fill bodies can also be sintered to one another for stabilization purposes. Between the fill bodies, the fill 22 is formed with hollow spaces which are in communication with one another, and through which the blast air flows. The fill 22 fills the cross-section of the throttle chamber 21 completely, so that all of the blast air must flow through the fill 22 and be throttled therein by back-ups at the fill bodies and by eddies in the hollow spaces.

Figure 5:
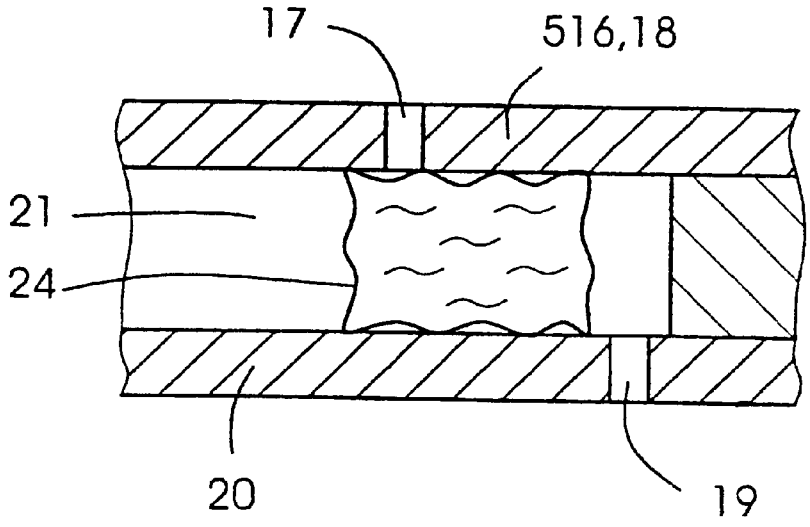

In the particular embodiment of the air throttle 516*a*, 516*b* or 516*c* represented in FIG. 5, the fill 22 is replaced by a textile throttle piece 24, for example, a fabric or fleece, inserted in the throttle chamber 21. In order to fill the throttle chamber 21 completely from the floor 20 to the ceiling 18 with the filter-type throttle piece 24, the latter may be formed of a single, sufficiently voluminous layer, or may be wound into a multilayer insert or stretched out in the throttle chamber 21. The blast air flowing through the throttle piece 24 is throttled by back-ups at threads or fibers and by eddies in pores of the throttle piece 24.

Figure 6A:
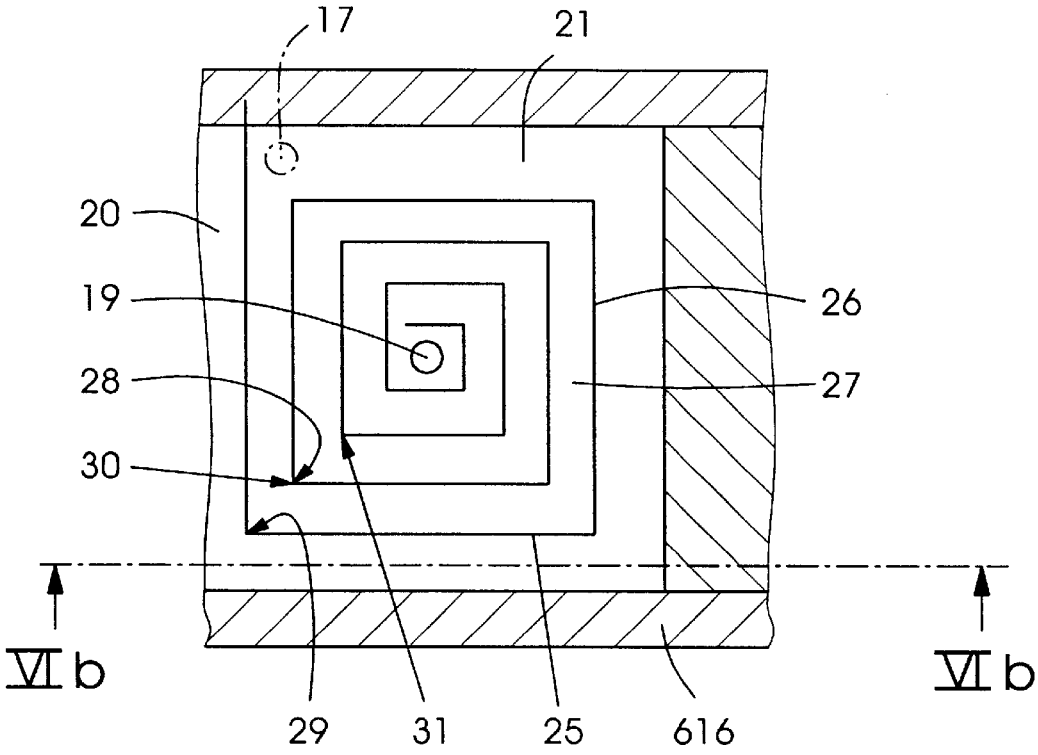
Figure 6B:
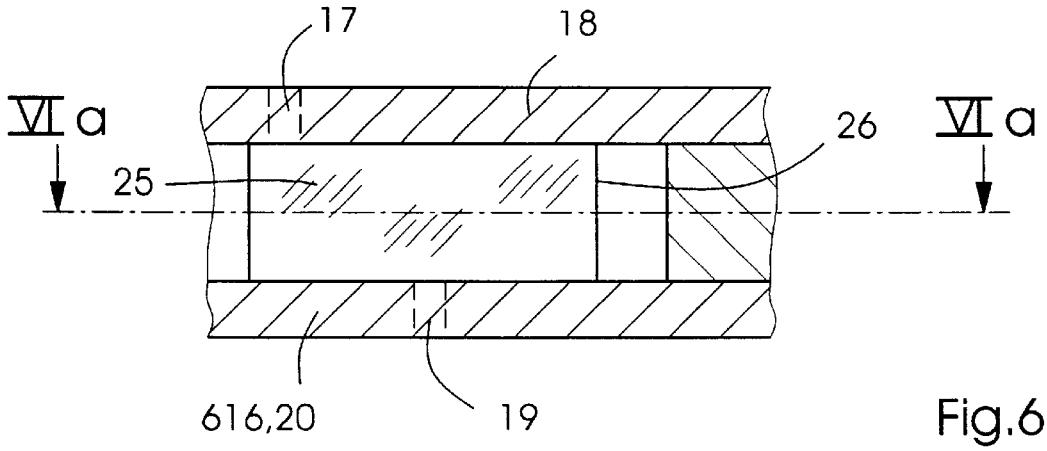
Figure 7A:
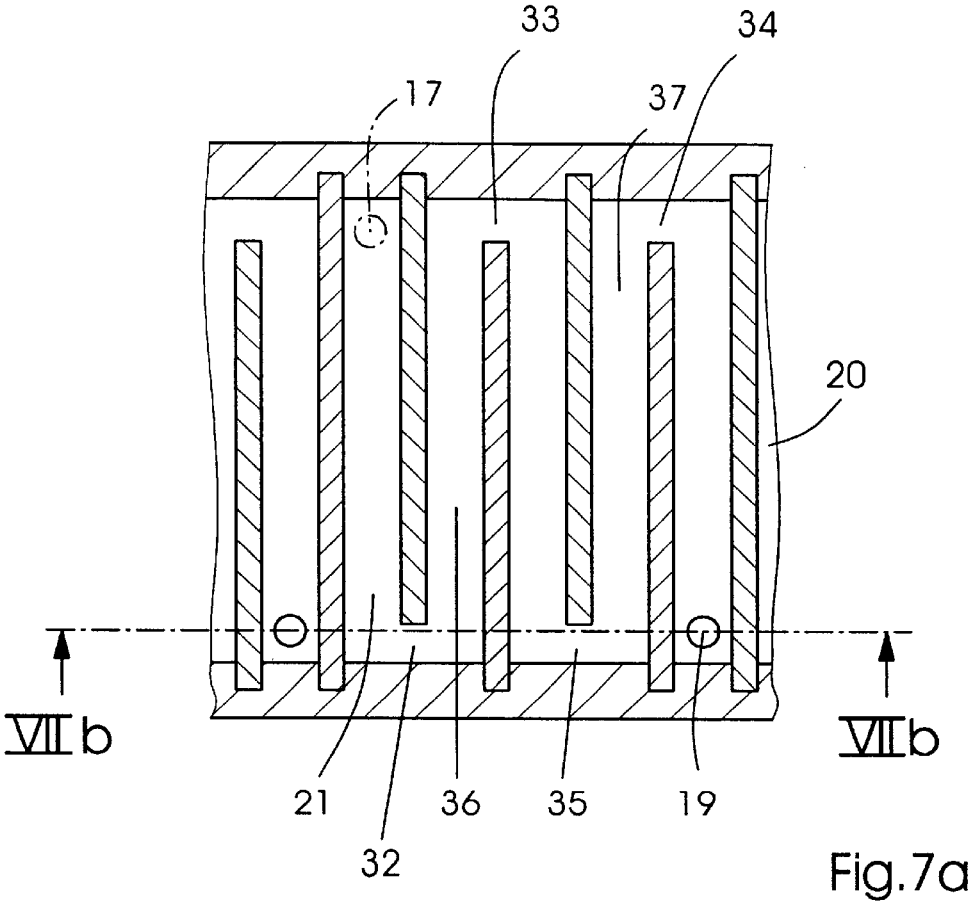
Figure 7B:
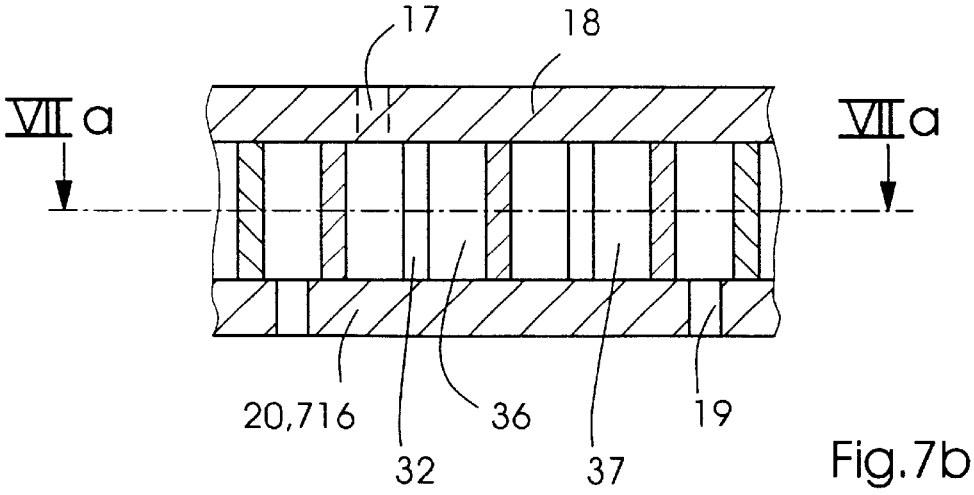

FIG. 6*a*, which is a horizontal sectional view taken along the line VIa—VIa in FIG. 6*b*, and FIG. 6*b*, which is a vertical sectional view taken along the line VIb—VIb in FIG. 6*a*, represent an air throttle 616*a*, 616*b* or 616*c* having air guide walls 25 and 26 which are disposed in the throttle chamber 21 at an angle to one another, namely orthogonally, thereby creating an air channel 27 in the shape of a polygonal spiral which conducts the blasted air between the air guide walls 25 and 26 from the inlet 19 to the outlet 17 of the throttle. The blast air flowing through the air channel 27 builds up in corner angles 28 and 29 of the air channel 27 and eddies at corner edges 30 and 31 of the air guide walls 25 and 26, thereby throttling the airflow. The air guide walls 25 and 26 have a very intense surface abrasiveness or roughness, which is produced by treating the walls 25 and 26 with sandblasting, for example, and which contributes to reducing the flow rate of the blast air in the air channel 27 by increasing the friction.

In the air throttle 716*a*, 716*b* or 716*c* (note FIG. 6*a* (horizontal section) and FIG. 6*b* (vertical section)), the throttle chamber 21 contains air barriers 32 and 33 in the form of damming walls. The air barriers 32 and 33 are disposed alternatingly in two rows, and overlap one another up to the narrow air gaps 34 and 35. Between the air barriers 62 and 63, eddy chambers 74 and 75 are located, which, with the air gaps 34 and 35, form a meandering air channel leading from the throttle inlet 19 to the outlet 17, wherein the blast air is throttled.

A sandwich construction of the air throttle 716*a*, 716*b* or 716*c* is also conceivable, wherein the throttle ceiling 18 and the throttle floor 19 are constructed as layers between which an intermediate layer in disposed, from which the meandering air channel and the eddy chambers are excavated. Such an air channel can be produced easily, for example, by stamping or punching out the intermediate layer, and can form a lamellar throttle packet in a compound or multiple arrangement.

Figure 8:
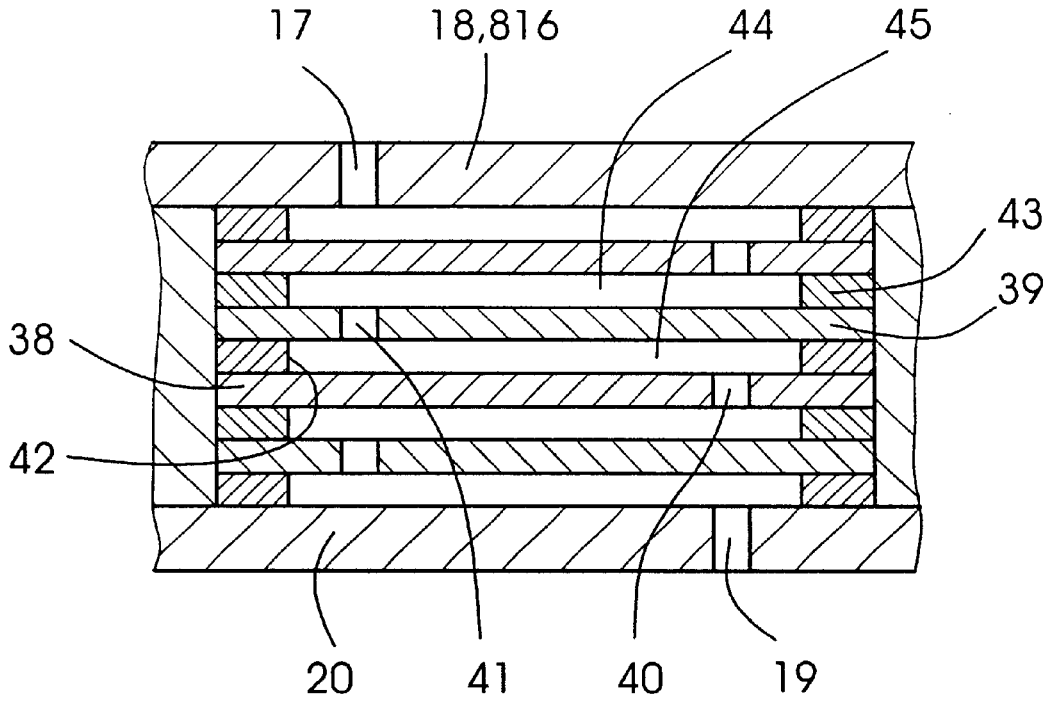

FIG. 8 represents a section of the air throttle 816*a*, 816*b* or 815*c*, which is formed of perforated plates 38 and 39 overlapping in the throttle chamber 21. Each of the perforated plates 38 and 39 is formed with at least one hole 40 and 41, respectively, which is disposed in the plane of the plate at an offset relative to at least one hole 41 and 40, respectively, of the respective adjacent perforated plate. Thus, the holes 40 and 41 forming a meandering air channel are out of alignment with one another and overlap solid surfaces of the respective perforated plates 38 and 39. Spacer members 42 and 43 hold the perforated plates 38 and 39 at a spaced distance from one another and define volumes of eddy chambers 44 and 45 which are situated between the perforated plates 38 and 39, and through which the blast air passes. The blast air stows or backs up in front of the holes 40 and 41, forming bottlenecks in the flow path, and eddies in the eddy chambers 44 and 45. The throttling effect of the air throttles 816*a*, 816*b* or 816*c*, just as that of the throttles 616*a* to 616*c* and 716*a* to 716*c*, is thus based upon reducing the flow rate of the blast air by a multiple deflection of the air flow in the throttle chamber 21.

We claim:

1. A guiding device in a machine for processing sheets of printing material, comprising a guide surface, unthrottled air nozzles for contact-free guidance of the sheets, and throttled air nozzles arranged in said guide surface at locations prone to contact by the sheets.

2. The guiding device according to claim 1, wherein said throttled air nozzles are located at a contact-prone curve of said guide surface.

3. The guiding device according to claim 1, wherein said throttled air nozzles are located at a contact-prone end region of said guide surface.

4. The guiding device according to claim 1, wherein said unthrottled air nozzles are pneumatically connected by way of a first air conducting system, and said throttled air nozzles are pneumatically connected by way of a second air conducting system, for providing a prevailing air pressure in said first air conducting system which is less than an air pressure prevailing in said second air conducting system.

5. The guiding device according to claim 1, wherein at least one of said throttled air nozzles is assigned to an air throttle.

6. The guiding device according to claim 5, wherein said air throttle includes a fill.

7. The guiding device according to claim 5, wherein said air throttle includes a throttle piece being a filter.

8. The guiding device according to claim 5, wherein said air throttle is formed with a spiral air channel.

9. The guiding device according to claim 5, wherein said air throttle includes protruding air barriers and eddy chambers located therebetween.

10. The guiding device according to claim 5, wherein said air throttle includes perforated plates disposed on top of one another, with eddy chambers located therebetween.

11. The guiding device according to claim 1, wherein said throttled air nozzles are blast air nozzles.

12. The guiding device according to claim 1, wherein said unthrottled air nozzles are blast air nozzles.

13. A guiding device in a machine for processing sheets of printing material, comprising an air throttle, unthrottled air nozzles for contact-free guidance of the sheets, and throttled air nozzles disposed at locations prone to contact by the sheets, at least one of said throttled air nozzles being operably disposed with said air throttle.

14. The guiding device according to claim 1, wherein said guide surface has certain locations that are more prone to contact by the sheets than other locations in said guide surface, and said throttled nozzles are located in said certain locations.

* * * * *